United States Patent [19]

Muzslay

[11] Patent Number: 4,639,061

[45] Date of Patent: Jan. 27, 1987

[54] ENVIRONMENTALLY SEALED CONNECTOR

[75] Inventor: Steven Z. Muzslay, Huntington Beach, Calif.

[73] Assignee: ITT Corporation, New York, N.Y.

[21] Appl. No.: 672,536

[22] Filed: Nov. 19, 1984

[51] Int. Cl.[4] ..... H01R 11/00

[52] U.S. Cl. ..... 339/59 M; 339/186 R

[58] Field of Search ..... 339/59 R, 59 M, 60 R, 339/60 M, 186 R, 186 M

[56] References Cited

U.S. PATENT DOCUMENTS

| | | | |
|---|---|---|---|
| 3,727,172 | 4/1973 | Clark | 339/59 M |
| 3,937,545 | 2/1976 | Cairns et al. | 339/60 R |
| 3,970,352 | 7/1976 | Dorrell et al. | 339/59 M |
| 4,513,356 | 4/1985 | Mikola | 339/186 R |
| 4,560,219 | 12/1985 | Chapelot | 339/60 R |

*Primary Examiner*—Gil Weidenfeld
*Assistant Examiner*—Paula A. Austin
*Attorney, Agent, or Firm*—R. G. Wick; T. L. Peterson

[57] ABSTRACT

A high performance, low-cost sealed electrical connector is disclosed which is suitable for rugged environmental applications. The connector uses three double-shot molded parts each comprising a rigid molded plastic section and an elastomeric sealing section. The sealing sections of two parts provide seals for the insulated wires connected to the contacts in the plug and receptacle of the connector. The elastomeric section of the third part provides the interfacial seal between the plug and receptacle. The contacts are removably mounted in the plug and receptacle by the use of integral retention fingers formed on the plastic sections of the plug and receptacle. An improved stabilized latching arrangement is also disclosed.

18 Claims, 11 Drawing Figures

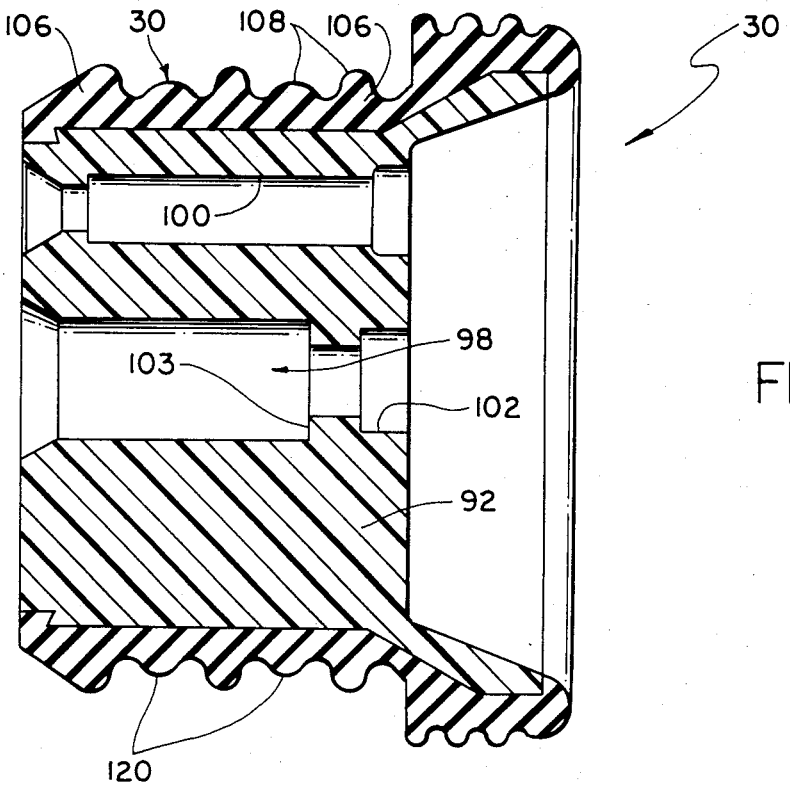
FIG. 8
FIG. 9
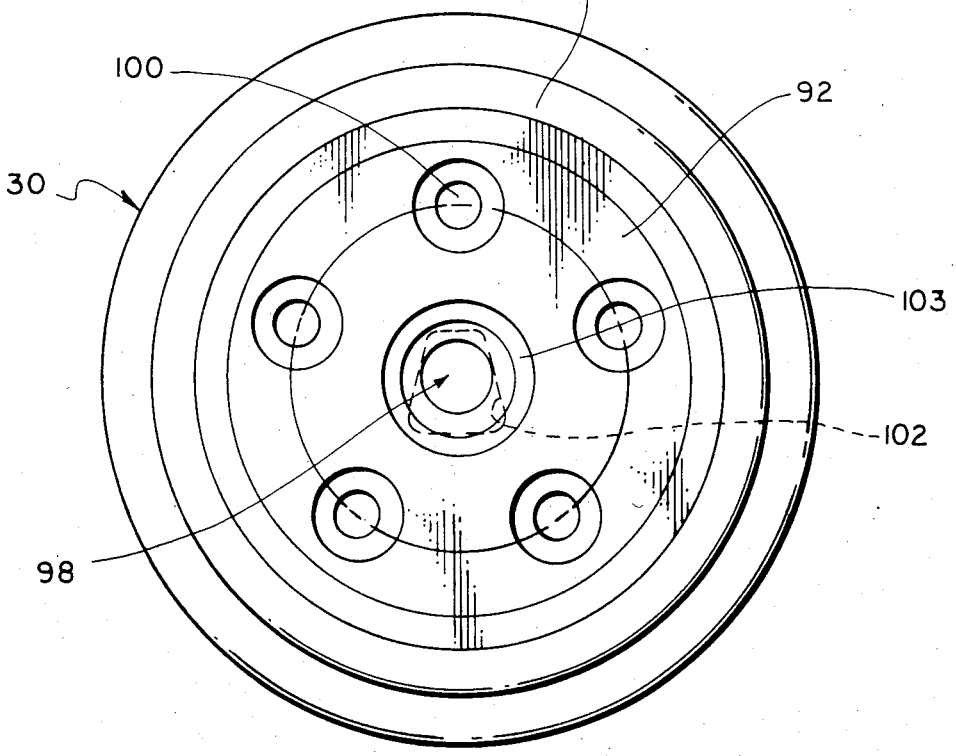

FIG. 10
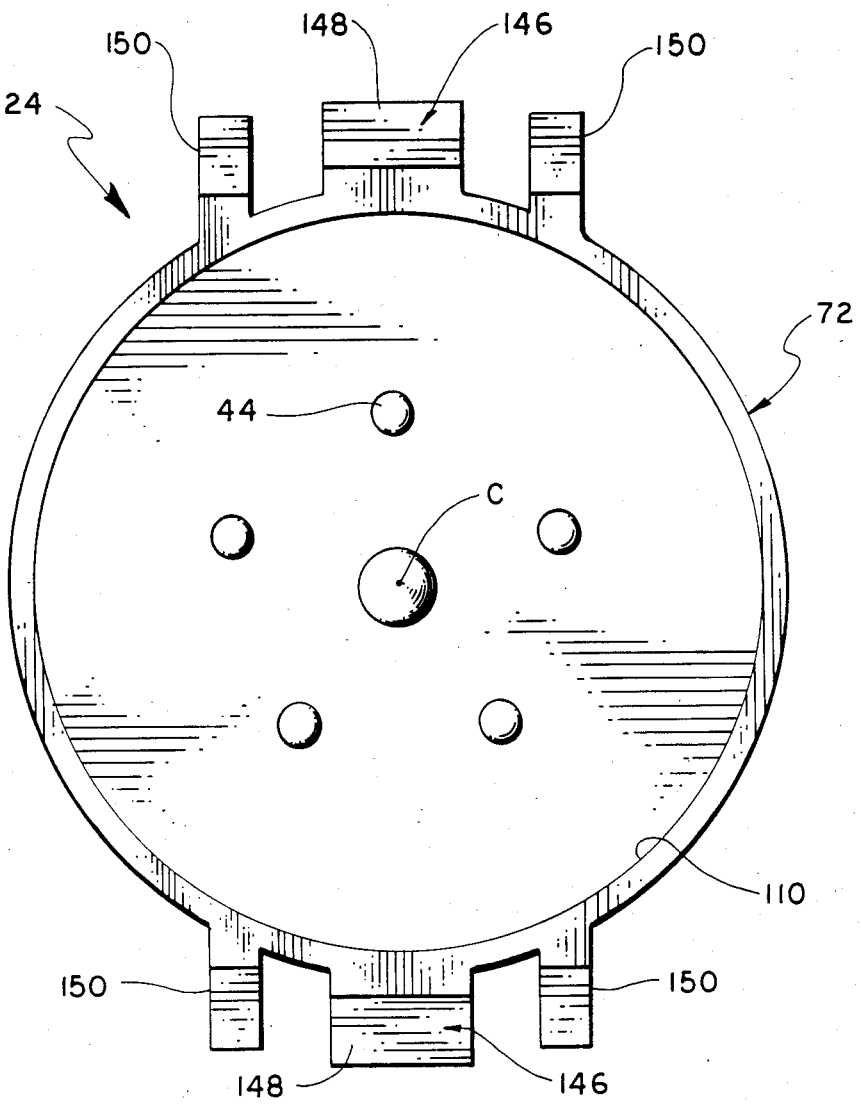
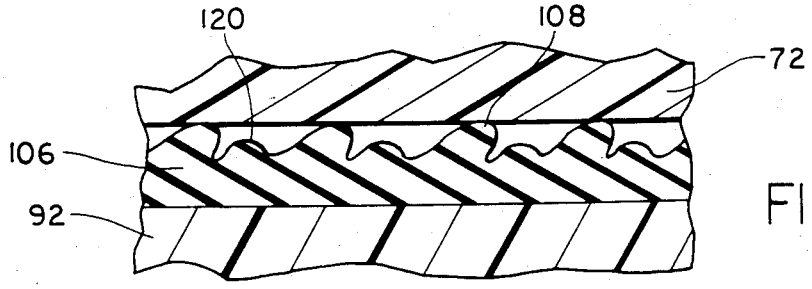
FIG. 11

ENVIRONMENTALLY SEALED CONNECTOR

BACKGROUND OF THE INVENTION

The present invention relates generally to an electrical connector and, more particularly, to a low-cost sealed connector particularly suited for rugged environmental applications, for example, on automotive vehicles, trucks or tractors.

There are presently available a number of environmentally sealed or waterproof connectors which are specially designed to prevent intrusion of moisture or other contaminants into the area of the connector containing the electrical contacts.

An example of one such connector is disclosed in U.S. Pat. No. 3,880,487 to Goodman et al. in which both the plug and the receptacle are formed of a unitary body of elastic pliant molded material in which the mating contacts are mounted. While the Goodman et al. connector has been successfully used for many environmentally applications for a number of years, in order to mount and remove the contacts from the plug and receptacle bodies, it is necessary to utilize a rather complex contact insertion apparatus as disclosed in U.S. Pat. No. 3,955,414 to Anderson. The use of such apparatus adds to the cost of assembly, and thus the cost of manufacture, of the connector and also requires that such apparatus be available in the field if rapairs are required there. Also, if substantial side loads are applied to the connector to cause cocking between the plug and receptacle, it is possible that the seal at the interface of the plug and receptacle may be impaired.

Other environmentally sealed connectors are disclosed in U.S. Pat. Nos. 3,930,705; 3,937,545 and 4,214,802. The connectors disclosed in such patents have one or more disadvantages as, for example, high cost of manufacture, lack of stabilization in the latching arrangement which permits cocking of the plug and receptacle, lack of a positive latching of the plug and receptacle and difficulty in replacing the contacts in the connector bodies.

It is the object of the present invention to provide an improved environmentally sealed connector which is relatively inexpensive to manufacture, is capable of maintaining a sealed connection even under severe environmental conditions, which allows the insertion and removal of contacts with the use of only a very simple tool, and provides a positive latching between the plug and receptacle which maintains the plug and receptacle in a stabilized condition that resists cocking of the plug and receptacle if side loads are applied thereto.

SUMMARY OF THE INVENTION

According to a principal aspect of the present invention, there is provided an environmentally sealed connector which comprises three double-shot molded pieces each consisting of a rigid molded plastic section and an elastomeric sealing section. An additional rigid molded plastic disc together with one of the double-shot pieces comprises the receptacle of the connector. The plastic section of two of the double-shot molded pieces are formed with plastic retention fingers for releasably retaining contacts in the contact passages formed in the parts. In the case of the receptacle, the plastic disc is fixedly mounted within a recess in the forward end of the plastic section of the double-shot molded piece for preventing forward movement of the contacts in the contact passages. The plastic section of the third double-shot molded piece is fixedly mounted on the front of the second double-shot molded piece which together form the plug of the connector, and serves to restrict forward movement of the contacts in the contact passages in the plug body. The elastomeric portion of the third double-shot molded piece is formed with annular sealing ribs which engage the cylindrical wall of the recess in the receptacle in sealing engagement therewith when the plug and receptacle are mated. Such arrangement provides a seal at the interface of the plug and receptacle, and seals at the rear of the plug and receptacle for sealing against the insulated wires which are connected to the contacts mounted in the connector. The contact retention fingers formed on the plastic sections of two of the double-shot molded pieces allow the contacts to be inserted into the connector, and withdrawn therefrom, by the use of a simple tubular tool, such as disclosed in U.S. Pat. No. 3,110,093 to Johnson, which is common use in the connector industry.

According to another aspect of the invention, there is provided an improved latching arrangement for a molded connector which embodies stabilizing keys that resist cocking of the plug and receptacle when side loads are applied to the connector thus ensuring that the connector will remain in a fully mated and sealed condition even when subjected to rough handling. The latching arrangement is also desirably provided with polarizing means which assures that the plug and receptacle can be mated in only one angular position relative to each other to assure that the contacts therein will be properly mated when the plug is pushed into the receptacle.

BRIEF DESCRIPTION OF THE DRAWINGS

FIG. 8 is a longitudinal sectional view taken through the front part of the plug;

FIG. 9 is a front view of the front part of the plug;

FIG. 10 is a front view of the receptacle of the connector; and

FIG. 11 is a fragmentary view showing the condition of the sealing ribs on the plug when the plug is mated with the receptacle of the connector of the present invention.

DESCRIPTION OF THE PREFERRED EMBODIMENT

Figure 1:
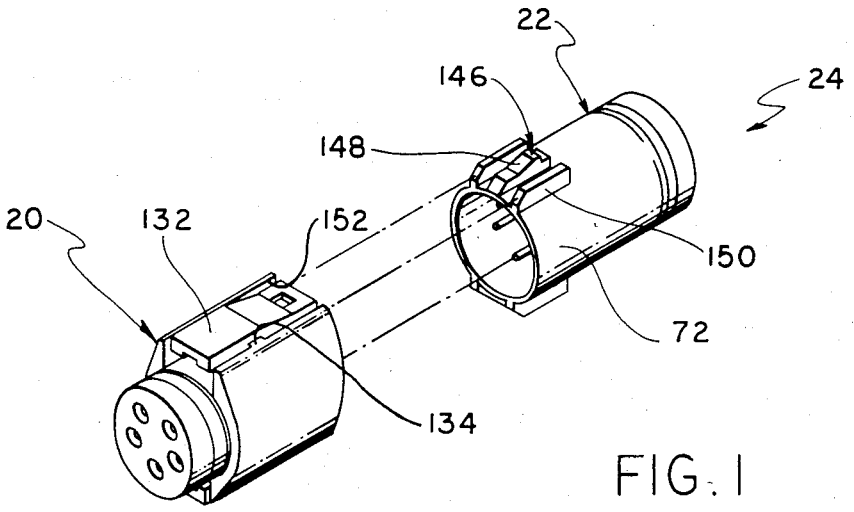
FIG. 1 is a perspective view showing the plug and receptacle of the connector of the invention in an unmated condition.
Figure 3:
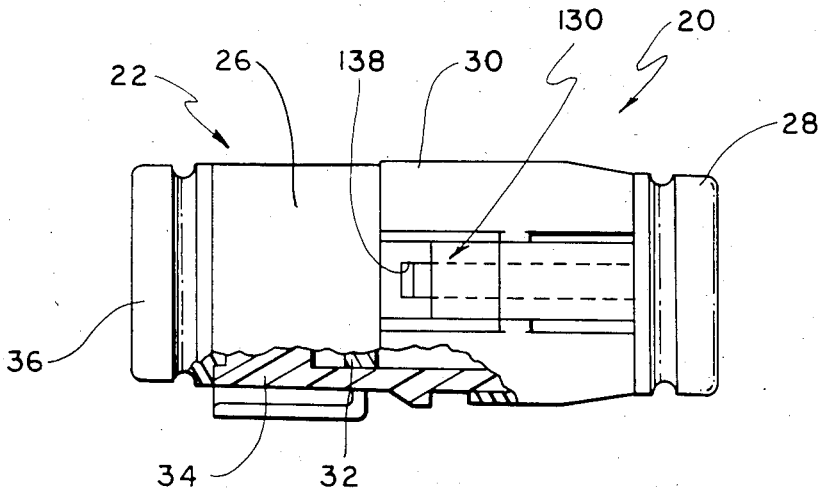
FIG. 3 is a top view of the connector illustrated in FIG. 2, with a portion of the connector shown in section.

Referring now the drawings in detail, there is illustrated in FIG. 1 the plug 20 and the receptacle 22 of the connector 24 of the invention in their unmated condition. The connector can be characterized as a shell-less connector since there is no metal shell surrounding the connector bodies.

Figure 2:
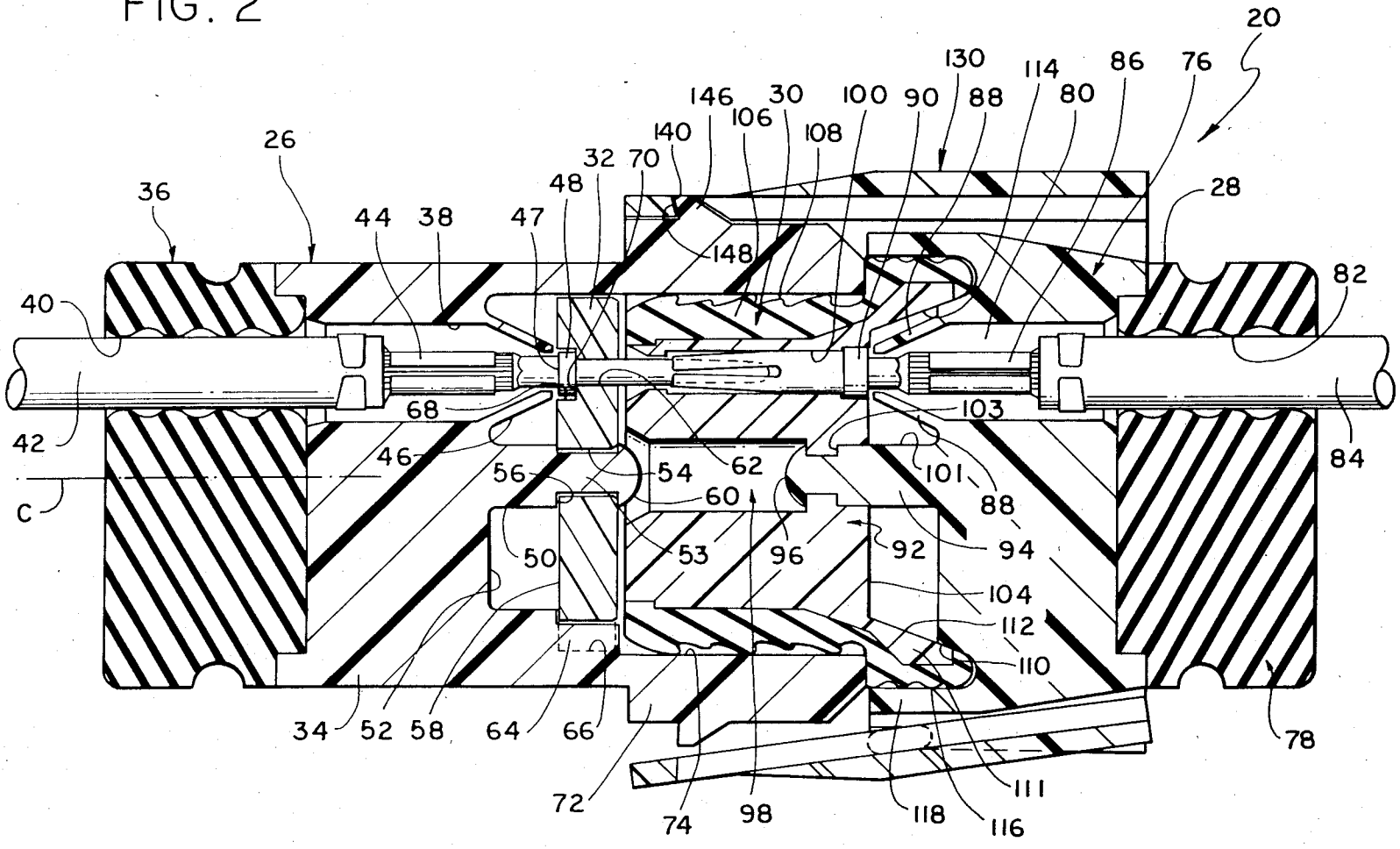
FIG. 2 is a longitudinal sectional view taken through the connector of the invention with the plug and receptacle fully mated, with the lower latching lever of the connector being shown in a released position.
Figure 4:
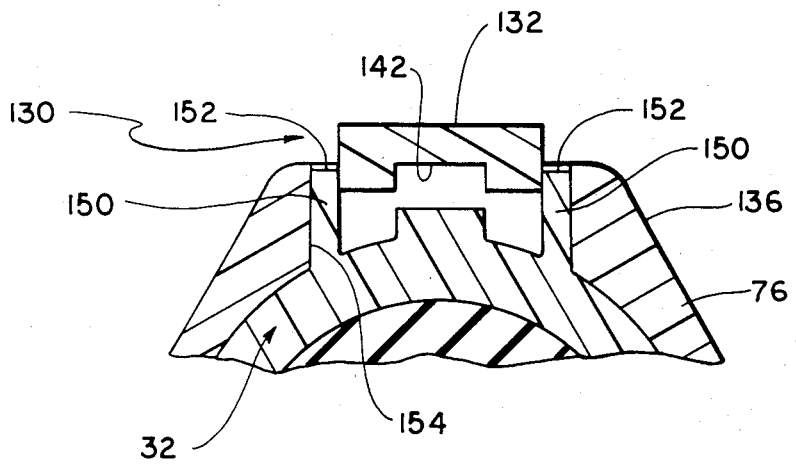
FIG. 4 is a fragmentary, transverse sectional view taken along line 4—4 of FIG. 2 showing details of the construction of the stabilized latching arrangement of the invention.
Figure 5:
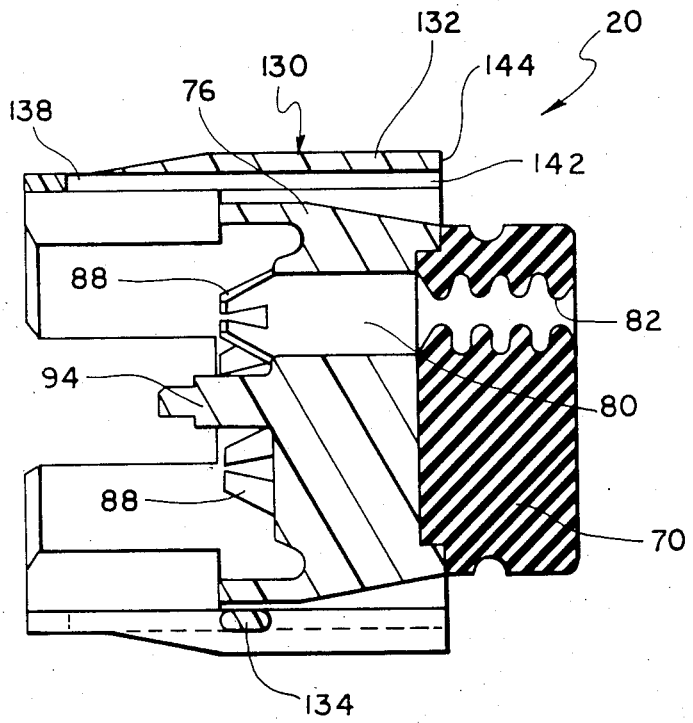
FIG. 5 is a sectional view taken along line 5—5 of FIG. 6 showing the details of structure of the rear part of the plug of the invention.

As best seen in FIG. 2, the connector 24 comprises three double-shot molded pieces 26, 28, and 30 and a rigid molded plastic disc 32. Each double-shot molded piece consists of a rigid molded plastic section and an elastomeric section, such as silicone rubber. Double-shot molding processes are well known in the connector art. For example, see British Pat. Nos. 968,707 and U.S. Pat. No. 4,293,182. A suitable plastic which may be utilized with silicone rubber in a double-shot molding process is Santoprene, a polyolefin based thermoplastic sold by Monsanto Corporation.

The body of the receptacle 22 of the connector comprises the double-shot molded piece 26 and the disc 32. The body of the plug 20 of the connector comprises the two double-shot molded pieces 28 and 30.

The disc 32 may be considered the front part of the receptacle 22 while the double-shot piece 26 can be considered the rear part. The rear part consists of a front plastic section 34 and a rear elastomeric section 36. A plurality of contact passages 38 extend through the rear part 26 of the connector body, five such passages being shown in the drawings by way of illustration only. It is understood that the connector may contain any number of contact passages, including only a single passage. In the case where a plurality of passages are used, preferably the passages are spaced an equal distance outwardly from the center axis C of the connector body, as seen in FIG. 10. Annular sealing ribs 40 are formed on the wall of each contact passage in the elastomeric rear section 36 of the receptacle body for making a sealing engagement with the insulated wire 42 that is connected to a pin contact 44 mounted in the forward position of the contact passage. A plurality of forwardly and inwardly extending radially deflectable integral contact retention fingers 46 are formed on the front section 34 of the rear part 26 of the receptacle for each contact passage. The retention fingers are similar to the retention fingers disclosed in U.S. Pat. No. 3,165,369, and function in the same manner. The tips of the fingers are positioned behind a shoulder 47 provided by flange 48 on the body of the contact 44 for restricting rearward movement of the contact in the passage 38.

A cylindrical post 50 extends outwardly from a forwardly facing surface 52 on the front section 34 of the receptacle body concentric with the center line C. The forward end 53 of the post, which is of reduced diameter, extends into a central hole 54 formed in the disc 32. A forwardly facing shoulder 56 is formed on the post which positions the disc so that its rear face 58 is located in front of the ends of the retention fingers 46. The disc 32 is retained on the post by heat or cold-staking the tip of the post to form a head 60 which extends over the front face of the disc. The disc contains five bores 62 which are aligned with the contact passages 38. Such alignment is assured by a key 64 on the front section 34 which engages a slot 66 in the disc that opens at the outer periphery of the disc. The flange 48 of each contact extends into a counter bore 68 opening at the rear face 58 of the disc. The bottom 70 of the counter bore provides a rearwardly facing shoulder which is engaged by the front of the flange 48 on the contact for restricting forward movement of the contact in the passage 38. The contact 44 can be removed from the passage 38 by inserting a tubular contact insertion-extraction tool, such as disclosed in the Johnson patent mentioned above, into the rear of the contact passage to deflect the fingers 46 radially outwardly, thus allowing the contact to be withdrawn rearwardly from the body of the receptacle 22.

The front section 34 of the rear part 26 of the receptacle 22 embodies a forwardly extending cylindrical wall 72 providing a cylindrical recess 74 which receives the forward end of the plug 20 when the plug and receptacle are mated together.

Referring now to the plug 20, the double-shot molded piece 30 can be considered the front part of the plug, while the double-shot molded piece 28 can be considered the rear part. The rear part 28 is very similar to the rear part 26 of the revceptacle 22 in that it comprises a front plastic section 76 and a rear elastomeric section 78. Five contact passages 80 extend through the rear part 28 in the same pattern as the passages 30 in the rear part 26 of the receptacle. Annular sealing ribs 82 are formed on the wall of each passage in the elastomeric rear section 78 which seal against the insulated wire 84 connected to a socket contact 86 mounted in the contact passage. Integral contact retention fingers 88 are formed on the front section 76 of the rear part 28 similar to the retention fingers 46. The retention fingers 88 cooperate with a flange 90 on the socket contact to restrict rearward movement of the contact in the passage 80. The retention fingers may be released from behind the flange to allow rearward withdrawal of the contact from the passage 80 in the same manner described previously herein with respect to the retention fingers 46 and pin contact 44.

Figure 6:
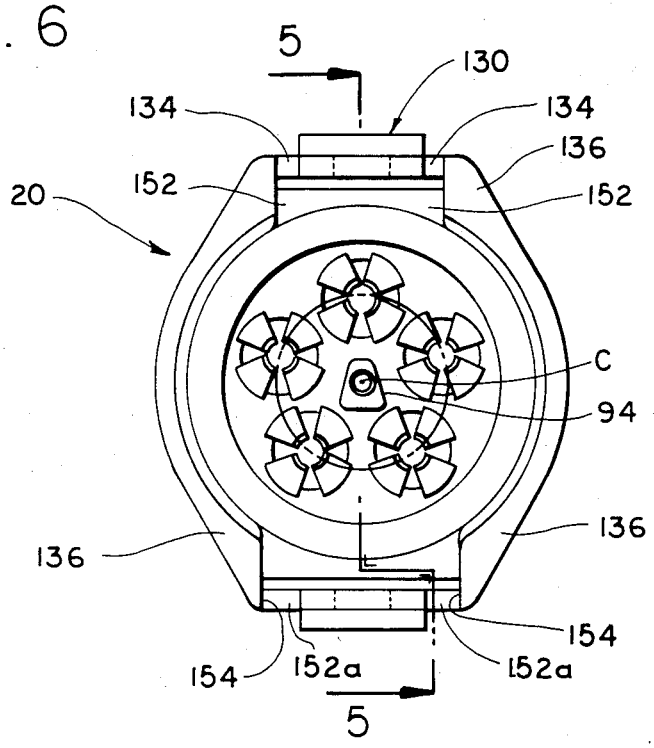
FIG. 6 is a front end view of the rear part of the plug illustrated in FIG. 5.
Figure 7:
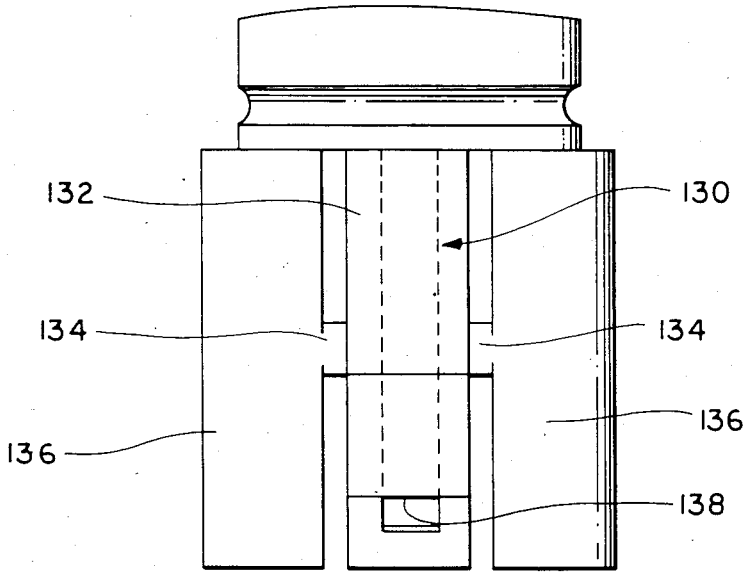
FIG. 7 is a top view of the rear part of the plug illustrated in FIGS. 5 and 6.

The front part 30 of the plug 20 comprises an inner plastic body 92 which is fixedly mounted on the forward end of a post 94 on the center line C of the plug 20. The forward end 93 of the post is circular and passes through a central hole 95 in the plastic body 92. The tip of the post is deformed to provide a retention head 96. A central bore 98 is formed in the body 92 which opens at its front face, and allows the insertion of a suitble tool to heat or cold-stake the tip of the post 94 to form the head 96. The plastic body 92 has five axially extending bores therethrough which are aligned with the contact passages 80. Proper orientation of the body 92 to align the bores 100 with the passages 80 is achieved by shaping the rear portion 101 of post 94 to have a trapezoidal crosssection which fits in a complementary trapezoid-shaped recess 102 that opens at the rear face of the body 92, as seen in FIGS. 6 and 9. A forwardly facing shoulder 103 on the post properly locates platic body 92 so that its rear face 104 is located just in front of the tips of retention fingers 88.

The front part 30 of the plug 20 also includes an elastomeric sealing section 106 which surrounds the plastic body 92. The sealing section has a plurality of outwardly extending annular sealing ribs 108 which are in sealing engagement with the inner cylindrical surface 110 of the wall 72 of the receptacle 22 when the forward end of the plug is pushed into the recess 74 in the receptacle as seen in FIGS. 2 and 11.

It is noted that the rear portion 111 of the plastic body 92 flares outwardly to provide an inner conical surface 112 which is engaged by a matching outer conical surface 114 formed on the forward portion of the front section 26 of the rear part 28 of the plug. In addition, the sealing section 106 of the front part 30 extends outwardly around and behind the flared rear portion 111 of the body 92, and is formed on its outer surface with a plurality of outwardly extending annular sealing ribs 116 which are in sealing engagement with the inner surface of a cylindrical wall 118 which is formed on the front section 76 of the rear part 28 and surrounds the flared portion 111 of the front part 30. The engagement between the matching conical surfaces 112 and 114 assures that the rear portion of the sealing section 106 will be properly positioned and maintained in sealing engagement with the cylindrical wall 118. Thus, the sealing section 106 of the double-shot molded front part 30 of the plug 20 provides the interfacial seal between the plug and receptacle, and also provides an internal seal between the front part 30 and the rear part 28 of the plug.

Reference is now made to FIGS. 8 and 11 which best illustrate the sealing section 106 provided on the front part 30 of the plug 20. The sealing ribs 108 are spaced from each other by relatively smaller diameter annular ribs 120 providing therebetween annular grooves 122. The ratio of the outer diameter of the sealing ribs 108 to the inner diameter of the cylindrical recess 74 in the receptacle 22 is about 1.04. The outer diameter of the intermediate ribs 120 is slightly less than the diameter of the recess 74. When the front part 30 of the plug is pushed into the recess 74 when the plug and receptacle are mated, the sealing ribs 108 will deform by folding rearwardly into the grooves 122 behind the ribs as seen in FIG. 11. Because of the relief areas provided by the grooves 122, the sealing ribs 108 deform easily thereby allowing the plug to be mated with the receptacle of the connector smoothly, with relatively low force, yet an effective long-term seal is still obtained because of the limited compression setup of the folded elastomeric sealing ribs. The intermediate ribs 120 serve to limit the deformation of the sealing ribs 108. When the plug is withdrawn from the receptacle, the sealing ribs 108 will fold into the grooves 122 in front of the ribs thus permitting easy withdrawal of the plug from the receptacle.

There is provided for the connector 24 an integral latch arrangement, generally designated 130, which provides a positive latch between the plug and receptacle, and embodies stabilizing means which prevents cocking of the connector halves when side loads are applied thereto, and further includes polarizing means that assures that the plug and receptacle can be mated in only angular position of the two parts so that the contacts in the plug and receptacle will be properly positioned for mating when the plug is pushed into the receptacle. More specifically, the latching arrangement includes a pair of latch levers 132 located on opposite sides of the body of the plug 20. The levers are integral with the front section 76 of the rear part 28 of the plug. Each lever extends longitudinally, and is pivotally connected at its sides approximately in the middle of the lever by integral, aligned live hinge pivots 134 which are joined to upstanding integral walls 136 formed on the front part 32 of the body of the receptacle 22. The walls 136 extend along the sides of the levers to protective side covers which prevent the levers from being inadvertantly actuated or damaged during use of the connector. A rectangular opening 138 is formed in the forward end of each lever 132 in front of the pivots 134 providing a rearwardly facing latching shoulder 140. Each opening 138 is formed by a longitudinally extending groove 142 in the bottom of the lever which extends from the rear 144 of the lever forwardly to the shoulder 140 and opens outwardly at the outer surface of the lever.

Each latch lever cooperates with an integral catch 146 formed on the outer surface of the forward portion of front part 32 of the receptacle 22. Each catch has a tapered forward surface 148 which engages underneath the forward end of the lever when the plug and the receptacle are mated, urging the forward end of the lever outwardly until the catch reaches the opening 138, whereupon the forward end of the lever will spring inwardly due to torsion forces created in the pivots 138 whereby the catch 146 will extend into the opening 134 with the latch shoulder 140 bearing against the rear of the catch, thereby providing a positive interlock between the plug and receptacle. The interlock is released by applying pressure by the thumb and forefinger to the rear ends of the levers 132 causing the levers to pivot as a result of the live hinge pivots 134 undergoing torsion, thereby raising the forward ends of the levers to release the latching shoulders 140 from the catches 146 as seen in the lower part of FIG. 2. It is noted that the levers operate in a manner similar to that disclosed in U.S. Pat. No. 4,431,244 to Anhalt et al. assigned to the assignee of the present application.

The latching levers being on opposites sides of the connector assures that there will be no cocking of the plug and receptacle in a vertical plane as viewed in FIG. 2 if side loads are applied to the connector in such a plane. In order to prevent cocking of the connector in a horizontal plane, there are provided longidutinally extending stabilizing keys 150 on the outside of the front section 34 of the receptacle 22 spaced laterally from each catch 146, and located so as to slidably fit within longitudinally extending channels 152 which are provided between the upstanding walls 136 and each lever 132 on the plug 20. Preferably the keys 150 are dimensioned and located so as to be slightly spaced from the sides of the levers 132 so that the keys will not interfere in pivotal movement of the levers, and the outside surfaces of the keys 150 have a relatively close sliding fit with the interior surfaces 154 of the walls 136 thereby assuring there will be no cocking in the horizontal plane of the connector halves if side loads in such plane are applied to the connector.

In order to provide polarization between the plug and receptacle so that they can be mated in only one angular position relative to each other, preferably one set of stabilizing keys **150*a*, namely the lower keys illustrated in FIG. 10, are wider than the upper keys 150, and the channels 152*a* in the plug 20 which receive such keys are also made wider a corresponding amount, as illustrated in FIG. 6, so that the keys 150*a* may slide into the channels 152*a*, but such keys may not enter into the narrower channels 150 on the opposite side of the receptacle 22. Thus, the cooperating keys and channels discussed above provide both stabilization and polarization for the connector, and the upstanding sidewalls 136 on the plug which provide the channels that receive the keys on the receptacle protect the latching levers 132** against damage and inadvertant actuation if the connector is subjected to rough handling during use.

While it is preferred that the three parts 26, 28 and 30 be double-shot molded pieces, the invention also contemplates that the rigid molded plastic section and the elastomeric section of each part be adhered to each other by a suitable adhesive.

What is claimed is:

1. A shell-less connector member comprising:

and insulative connector body comprising a front part and a rear part;

said rear part comprising a front section of relatively hard material and an integral rear section of elastomeric material;

at least one contact passage extending through said rear part;

a plurality of annular integral ribs on the wall of said passage in said rear section adapted to have a sealing fit with an insulated wire terminating in a contact in the forward portion of said passage in said front section;

integral contact retention fingers on said front section extending forwardly and inwardly from the wall of said passage for engaging a rearwardly facing shoulder on the contact to removably retain the contact in said passage;

means fixedly mounting said front part on said front section of said rear part, said front part being formed of a relatively hard material;

a bore extending through said front part concentric with said passage and adapted to receive the contact therein; and said from part having a rearwardly facing shoulder surrounding said bore for restricting forward movement of the contact in said passage;

said front part embodying an integral elastomeric sealing section having a first set of annular, outwardly extending sealing ribs thereon adapted to sealingly engage the inner cylindrical wall of a recess in a mating connector member when said sealing section is pushed into the recess;

said sealing section of said front part embodying a second set of annular, outwardly extending sealing ribs thereon behind said first set;

said front section of said rear part embodying a cylindrical inner surface surrounding said second set of sealing ribs; and said second set of sealing ribs are in sealing engagement with said inner surface.

2. A connector member as set forth in claim 1 wherein:

said rear part is a double-shot molded piece.

3. A connector member as set forth in claim 1 wherein:

said sealing ribs of said first set are spaced from each other by relatively smaller diameter annular ribs, said sealing ribs being spaced from said smaller diameter ribs to provide therebetween annular grooves, each said sealing rib deforming into the groove on the side of said sealing rib opposite the direction that said sealing section is pushed into or withdrawn from the recess.

4. A connector member as set forth in claim 1 wherein:

said mounting means comprises a post on said front section extending forwardly into a hole in said front part.

5. A connector member as set forth in claim 4 wherein:

said post extends through said hole; and the forward end of said post is deformed over a forwardly facing surface on said front part.

6. A connector member as set forth in claim 4 wherein:

there is a plurality of said passages in said rear part and a plurality of said bores in said front part each concentric with a respective one of said passages;

said body has a center axis;

said passages and bores are spaced outwardly from said center axis; and said post is located substantially on said center axis.

7. a connector member as set forth in claim 1 including:

means on said front section of said rear part and on said front part maintaining said second set of sealing ribs in sealing engagement with said inner surface.

8. A connector member as set forth in claim 7 wherein:

said maintaining means comprises matching conical surfaces on said front section of said rear part and on said front part.

9. An environmentally sealed connector comprising:

mating plug and receptacle connector members;

each said connector member comprising an insulative connector body having a front part and a rear part;

said rear part of each said connector member comprising a double-shot molded integral piece including a front section of relatively hard material and a rear elastomeric sealing grommet;

said front part of said receptacle connector member comprising a disc of relatively hard material fixedly mounted on said front section of said rear part of said receptcle connector member;

said front section of said receptacle connector member having a cylindrical wall extending forwardly of said disc providing a plug receiving recess;

said front part of said plug connector member comprising a double shot molded integral piece including a disc of relatively hard material and an integral elastomeric sealing section, said sealing section being adapted to be pushed into said recess;

said sealing section of said front part of said plug connector member embodying at least one additional annular sealing rib behind said first-mentioned sealing rib;

said disc being fixedly mounted on said front section of said rear part of said plug connector member, said sealing section having at least one annular sealing rib thereon adapted to be in sealing engagement with the inner surface of said cylindrical wall shen said sealing section of said plug connector member is pushed into said recess in said receptacle connector member;

contact passages extending through said connector bodies of said plug and receptacle connector members; and integral contact retention means on the front section of said rear part of each of said connectors members associated with each of said contact passages.

10. A connector as set forth in claim 9 wherein:

each said contact retention means comprises radially deflectable retention fingers extending forwardly and inwardly from the wall of its associated contact passage.

11. A connector as set forth in claim 9 wherein:

said front part of each connector member is secured to the rear part thereof by a post on said front section of said rear part extending forwardly into a hole in said front part.

12. A connector as set forth in claim 9 including:
latch means for releasably securing said connector members together; and
stabilizing means outside said connector bodies associated with said latch means for resisting cocking of said connector members relative to each other.

13. A connector as set forth in claim 12 including:
polarizing means operatively associated with said stabilizing means for allowing said connector members to be mated in only one angular position relative to each other.

14. A connector as set forth in claim 12 wherein:
said latch means includes pivoted, longitudinally extending levers on opposite sides of said plug connector member body, and
said stabilizing means includes a pair of longitudinally extending keys on opposite sides of said receptacle connector member body, the keys of each pair of said keys being laterally spaced apart and located so as to extend along the sides of a respective lever when said connector members are mated.

15. A connector as set forth in claim 14 wherein:
said stabilizing means further includes upstanding protective walls on said plug connector member body extending along the sides of said levers and spaced therefrom to define channels on opposite sides of each of said levers for slidably receiving a respective pair of said keys therein.

16. A connector as set forth in claim 15 wherein:
said keys of one pair of keys are wider than the keys of the other pair of keys; and
the channels on opposite sides of one of said levers are wider than the channels on opposite sides of the other lever so that said connector members may be mated in only one angular position relative to each other.

17. An electrical connector comprising:
mating first and second connector members;
each said connector member having an insulative body;
positive latch means for releasably securing said connector members together;
said latch means including longitudinally extending levers integrally molded on opposite sides of said first connector member with each said lever including a central live hinge adapted to bias the lever in the latched configuration and releasable only by compressing the non-latching end of said lever;
stabilizing means on said connector bodies for resisting cocking of said connector members relative to each other;
said stabilizing means including a pair of longitudinally extending keys on opposite sides of said second connector member body, the keys of each pair of said keys being laterally spaced apart and located so as to extend along the sides of a respective lever when said connector members are mated; and
said stabilizing means further including upstanding protective walls on said first connector member body extending along the sides of said levers and spaced therefrom to define channels on opposite sides of each of said levers for slidably receiving a respective pair of said keys therein.

18. A connector as set forth in claim 17 wherein:
said keys of one pair of keys are wider than the keys of the other pair of keys; and
the channels on opposite sides of one of said levers are wider than the channels on opposite sides of the other lever so that said connector members may be mated in only one angular position relative to each other.

* * * * *